US011659972B2

(12) United States Patent
Mi et al.

(10) Patent No.: US 11,659,972 B2
(45) Date of Patent: May 30, 2023

(54) MOISTURE-PROOF MAT AND INTELLIGENT CLEANING SYSTEM

(71) Applicant: SHENZHEN ROCK TIMES TECHNOLOGY CO., LTD., Shenzhen (CN)

(72) Inventors: Chang Mi, Shenzhen (CN); Xiaoming Liu, Shenzhen (CN)

(73) Assignee: SHENZHEN ROCK TIMES TECHNOLOGY CO., LTD., Shenzhen (CN)

( * ) Notice: Subject to any disclaimer, the term of this patent is extended or adjusted under 35 U.S.C. 154(b) by 556 days.

(21) Appl. No.: 16/764,320

(22) PCT Filed: Sep. 12, 2018

(86) PCT No.: PCT/CN2018/105339
§ 371 (c)(1),
(2) Date: May 14, 2020

(87) PCT Pub. No.: WO2019/056973
PCT Pub. Date: Mar. 28, 2019

(65) Prior Publication Data

US 2021/0106202 A1 Apr. 15, 2021

(30) Foreign Application Priority Data

Sep. 19, 2017 (CN) ..... 201721210564.3

(51) Int. Cl.
*A47L 11/40* (2006.01)
*A47L 11/28* (2006.01)

(52) U.S. Cl.
CPC ..... *A47L 11/4091* (2013.01); *A47L 11/28* (2013.01); *A47L 11/4005* (2013.01); *A47L 2201/022* (2013.01)

(58) Field of Classification Search
CPC .. A47L 11/4091; A47L 11/28; A47L 11/4005; A47L 2201/022
USPC ..... 15/98
See application file for complete search history.

(56) References Cited

U.S. PATENT DOCUMENTS 6,295,658 B1 * 10/2001 Jenkins ..... A47G 27/0225 4/251.1
9,265,396 B1 * 2/2016 Lu ..... A47L 13/16
(Continued)

FOREIGN PATENT DOCUMENTS

CN 102342805 A 2/2012
CN 104586324 A 5/2015
CN 205306905 U 6/2016
(Continued)

OTHER PUBLICATIONS

International Search Report and Written Opinion received in PCT/CN2018/105339 dated Feb. 3, 2019.
(Continued)

*Primary Examiner* — Yazan A Soofi
(74) *Attorney, Agent, or Firm* — Seed IP Law Group LLP

(57) ABSTRACT

In some examples, a moisture-proof mat is provided for an intelligent cleaning apparatus or an intelligent cleaning system. The intelligent cleaning apparatus is provided with a wet cleaning pad. The intelligent cleaning apparatus can be charged by a charging station. The moisture-proof mat may include an installation unit, configured to install the moisture-proof mat to the charging station. At least a portion of the moisture-proof mat is configured to be located under the wet cleaning pad (4) when the intelligent cleaning apparatus is charged by the charging station. When the intelligent cleaning apparatus is charged by the charging station, at least a portion of the moisture-proof mat is positioned under the intelligent cleaning apparatus.

19 Claims, 8 Drawing Sheets

(56) References Cited

U.S. PATENT DOCUMENTS

| | | | | |
|---|---|---|---|---|
| 11,435,192 | B1 * | 9/2022 | Ebrahimi Afrouzi | G05D 1/0274 |
| 2008/0104783 | A1 * | 5/2008 | Crawford | A47L 11/10 15/147.1 |
| 2011/0202175 | A1 * | 8/2011 | Romanov | A47L 11/4036 700/250 |
| 2014/0184144 | A1 * | 7/2014 | Henricksen | H02J 7/0044 34/104 |
| 2014/0366292 | A1 * | 12/2014 | Jung | A47L 11/4011 15/98 |
| 2015/0032259 | A1 * | 1/2015 | Kim | A47L 11/4008 700/255 |
| 2015/0142169 | A1 * | 5/2015 | Kim | A47L 11/282 15/98 |
| 2016/0270619 | A1 * | 9/2016 | Lu | A47L 9/0673 |
| 2019/0059680 | A1 * | 2/2019 | Fox | A47L 11/4091 |
| 2021/0169291 | A1 * | 6/2021 | Brown | A47L 11/4013 |
| 2021/0245081 | A1 * | 8/2021 | Kumar | B01D 46/0036 |

FOREIGN PATENT DOCUMENTS

| | | | |
|---|---|---|---|
| CN | 106137045 | A | 11/2016 |
| CN | 106166050 | A | 11/2016 |
| CN | 106264342 | A | 1/2017 |
| CN | 205911779 | U | 1/2017 |
| CN | 206211589 | U | 5/2017 |
| CN | 106955062 | A | 7/2017 |
| DE | 10 2008 018 511 | B4 | 10/2015 |
| EP | 2 888 981 | A2 | 7/2015 |
| JP | 2004350826 | A | 12/2004 |
| KR | 20150073592 | A | 7/2015 |
| KR | 20150073735 | A | 7/2015 |
| WO | 2005/055795 | A1 | 6/2005 |
| WO | 2017/052198 | A1 | 3/2017 |

OTHER PUBLICATIONS

Extended European Search Report for EP Application No. 18859306.5, dated Jul. 26, 2021, 7 pages.

* cited by examiner

MOISTURE-PROOF MAT AND INTELLIGENT CLEANING SYSTEM

CROSS-REFERENCE TO RELATED APPLICATIONS

This application is a national phase application under 35 U.S.C. § 371 of International Patent Application No. PCT/CN2018/105339, filed on Sep. 12, 2018 which claims priority to Chinese Patent Application No. 201721210564.3, filed on Sep. 19, 2017, the entire contents of both of which are incorporated herein by reference.

TECHNICAL FIELD

The disclosure generally relates to the field of cleaning tools, specifically relates to a moisture-proof mat and an intelligent cleaning system.

BACKGROUND

The existing automatic sweeping robot with a mopping function, usually requires a water tank. When the automatic sweeping robot is at rest (for example, when the automatic sweeping robot is being charged), the liquid in the water tank may continue to be output, leak onto the floor, and caused waste of cleaning fluid and damage to the floor.

Therefore, a moisture-proof mat and an intelligent cleaning system should be provided, to at least partially solve the above problems.

SUMMARY

A series of simplified forms are introduced in the content section of the disclosure, this will be explained in further detail in the DETAILED DESCRIPTION OF PREFERRED EMBODIMENTS section. The SUMMARY of the present disclosure is not intended to limit the key features and essential technical features of the claimed embodiments, nor does it mean trying to determine the scope of protection required for a technical solution.

To at least partially solve the above technical problems, according to an aspect of the disclosure, a moisture-proof mat for an intelligent cleaning apparatus is provided. The intelligent cleaning apparatus is provided with a wet cleaning pad. The intelligent cleaning apparatus can be charged by a charging station. The moisture-proof mat may include an installation unit. The installation unit is configured to install the moisture-proof mat to the charging station. At least a part of the moisture-proof mat is configured to be located under the wet cleaning pad, when the intelligent cleaning apparatus is charged by the charging station.

Preferably, the moisture-proof mat may further include at least one antiskid device, disposed on the bottom of the moisture-proof mat. The at least one antiskid device is made of a flexible material, and configured to protrude downward from the bottom of the moisture-proof mat.

Preferably, the moisture-proof mat may include a recess portion, the recess portion is configured to be located at least below the liquid discharge portion on a bottom surface of the wet cleaning pad. The surface of the recess portion does not contact the liquid discharge portion, when the intelligent cleaning apparatus is charged by the charging station.

Preferably, the shape of the moisture-proof mat matches the cross-sectional shape of the intelligent cleaning apparatus, and/or the shape of the moisture-proof mat is roughly round with a notch.

Preferably, the installation unit is a notch defined on the edge of the moisture-proof mat. The notch is recessed from the edge toward the center of the moisture-proof mat, so as to partially surround the charging station.

Preferably, the notch may include a buckle for matching the outer peripheral surface of the charging station. The buckle may include a first portion extends perpendicular to the extension direction of the moisture-proof mat and a second portion extends from the upper end of the first portion toward the charging station. The notch may also include a protrusion configured to fix to the charging station, and the protrusion extends toward the charging station. The notch may further define a groove on the surface thereof and configured to fix to the charging station.

Preferably, the moisture-proof mat has an rounded edge, to make the intelligent cleaning apparatus to move onto the moisture-proof mat conveniently.

According to another aspect of the disclosure, an intelligent cleaning system is provided. The intelligent cleaning system may include an intelligent cleaning apparatus, a charging station, and the moisture-proof mat. The intelligent cleaning apparatus is provided with a wet cleaning pad. The moisture-proof mat is installed to the charging station through the installation unit. When the intelligent cleaning apparatus is charged by the charging station, at least a part of the moisture-proof mat is located below the wet cleaning pad.

Preferably, one of the installation unit and the charging station includes a protrusion, another of the installation unit and the charging station defines a groove, and the protrusion is configured to cooperate with the groove to connect the moisture-proof mat to the charging station.

Preferably, the moisture-proof mat further comprising a liquid discharge portion disposed on a bottom surface of the wet cleaning pad, and the liquid discharge portion is configured to output the liquid in the wet cleaning pad when subjected to a pressure.

BRIEF DESCRIPTION OF THE DRAWINGS

In order to make the advantages of the present disclosure easier to understand, the disclosure briefly described above will be described in more detail by reference to the specific embodiments illustrated in the drawings. It will be understood that these drawings depict only typical embodiments of the disclosure, therefore, it should not be considered as a limitation on the scope of protection, the disclosure is described and explained with additional features and details in the drawings.

DETAILED DESCRIPTION OF PREFERRED EMBODIMENTS

In the discussion below, the details are given to provide a more complete understanding of the present disclosure. However, those skilled in the art can understand that, the disclosure may be practiced without one or more of these details. In specific example, in order to avoid confusion with the present disclosure, some of the technical features well known in the art are not described in detail.

Referring to FIGS. 1 to 7, the embodiments of the present disclosure provide an intelligent cleaning system and a moisture-proof mat. The intelligent cleaning system may include an intelligent cleaning apparatus, a charging station (not shown), and a moisture-proof mat.

Figure 1:
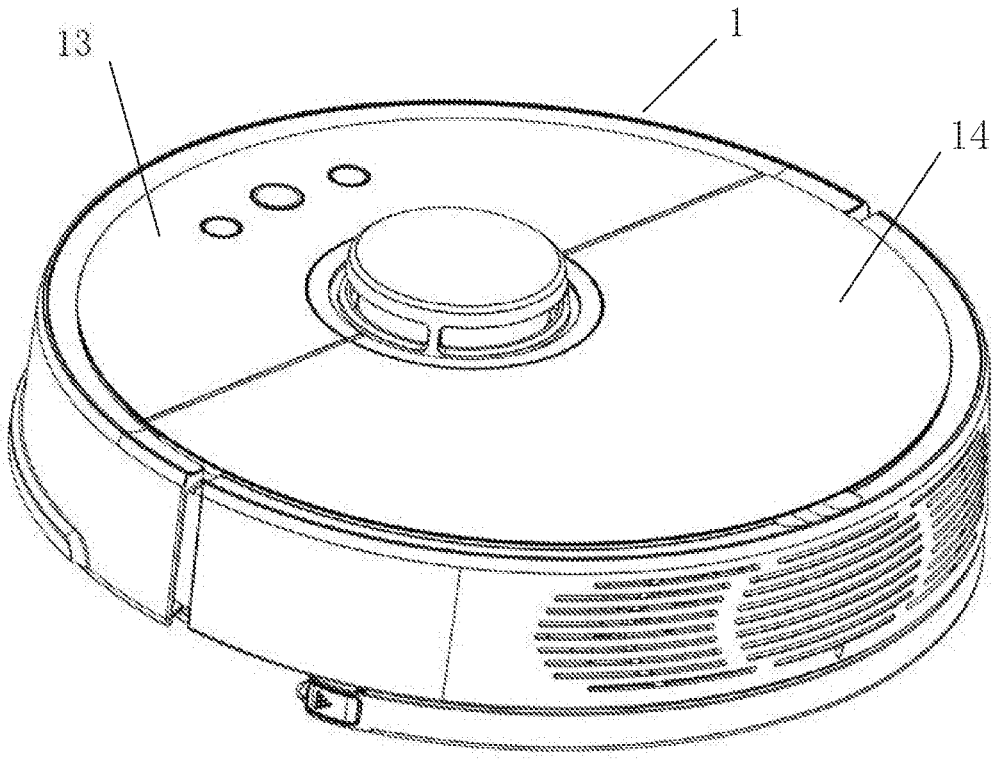
FIG. 1 is a schematic view of an intelligent cleaning apparatus of the intelligent cleaning system in accordance with an embodiment of the disclosure.
Figure 2:
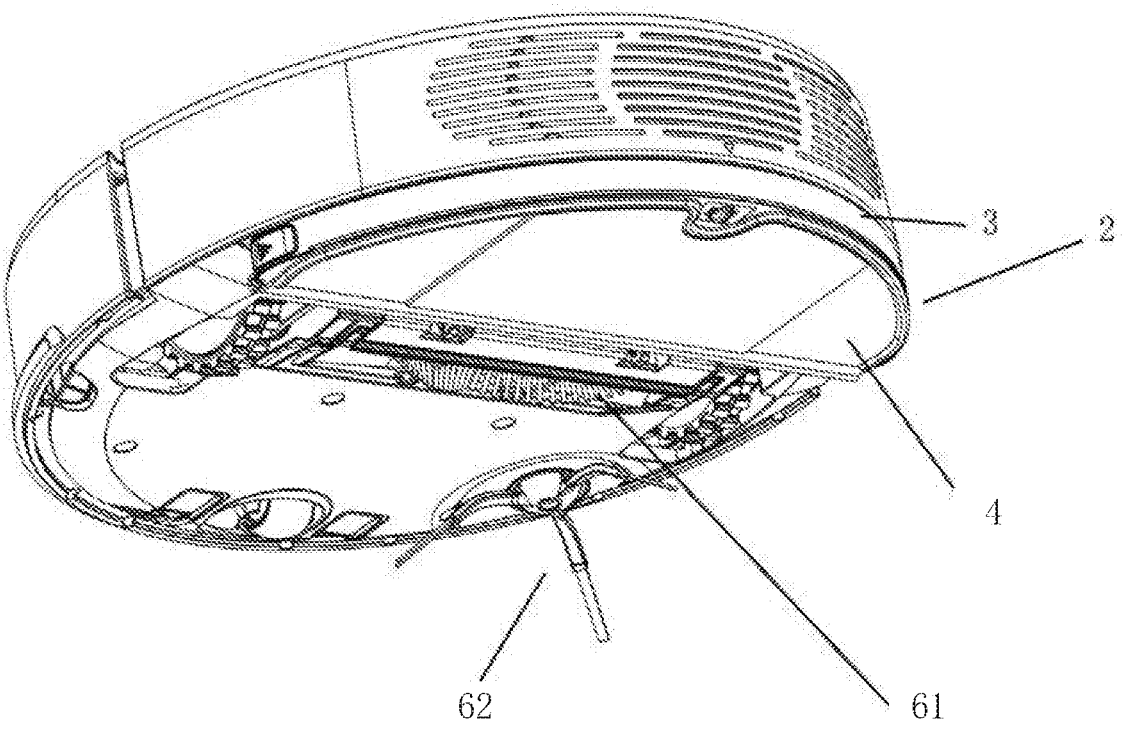
FIG. 2 is another schematic view of the intelligent cleaning apparatus in FIG. 1.
Figure 3:
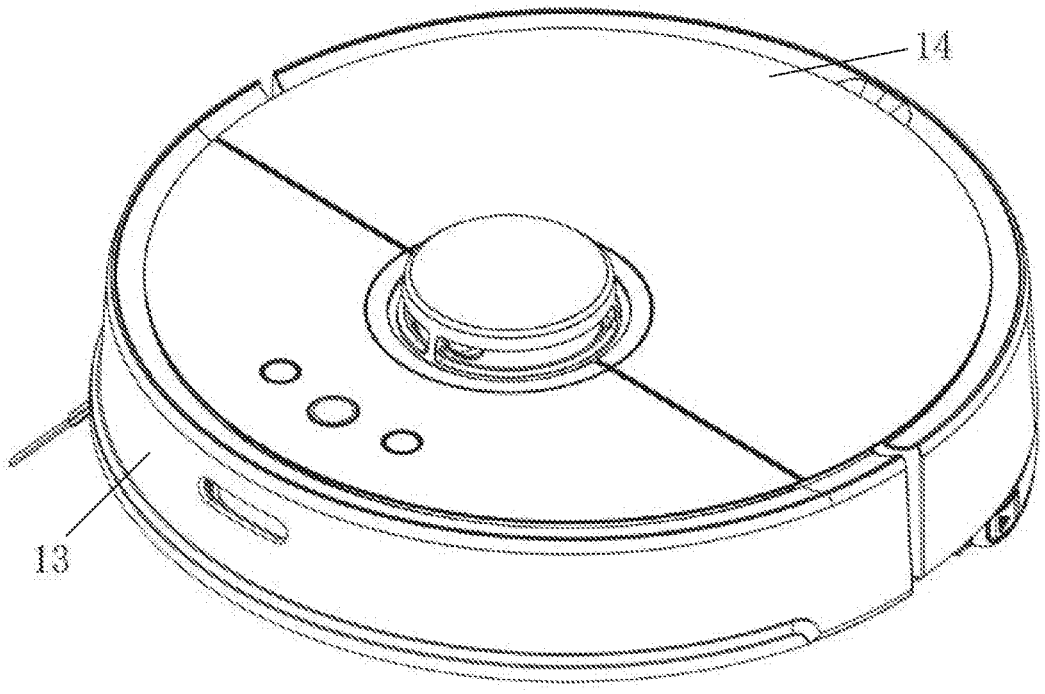
FIG. 3 is one more schematic view of the intelligent cleaning apparatus in FIG. 1.
Figure 4A:
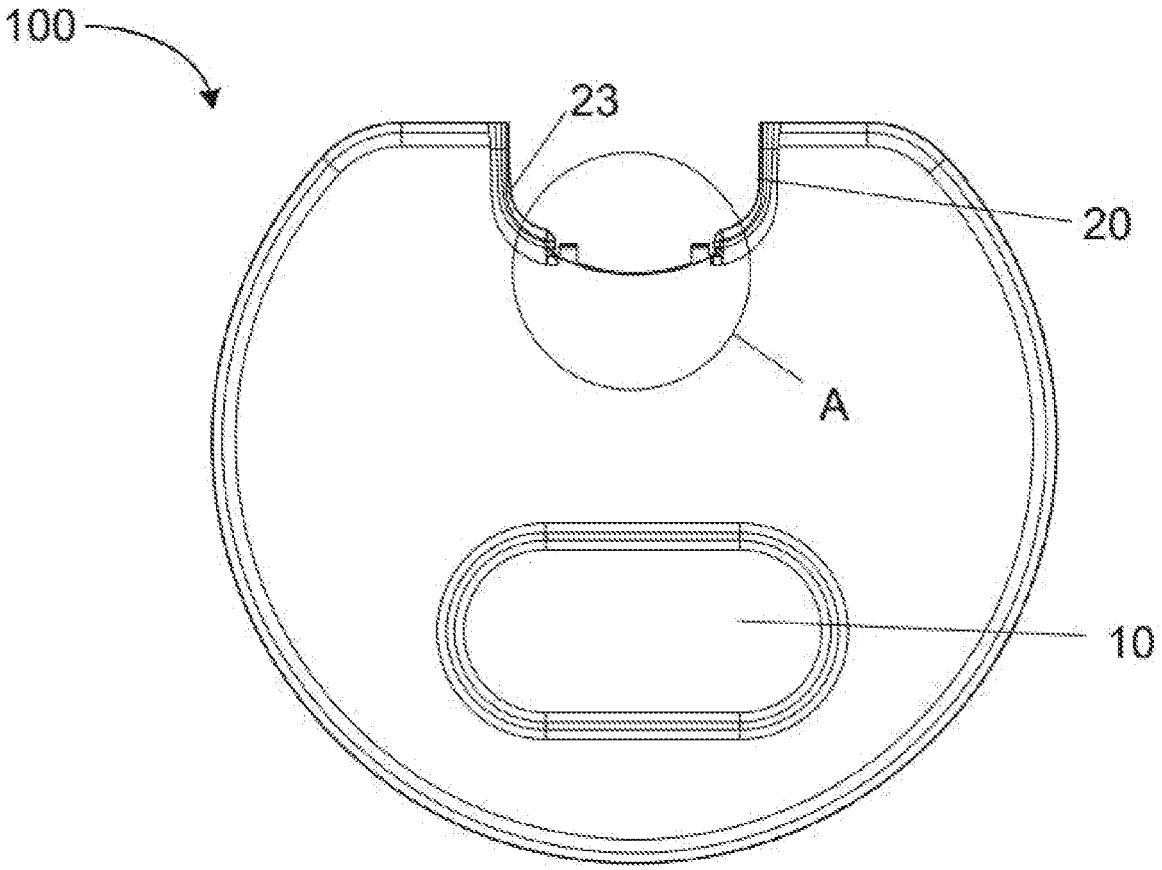
FIG. 4A is a top view of a moisture-proof mat of the intelligent cleaning system.
Figure 4B:
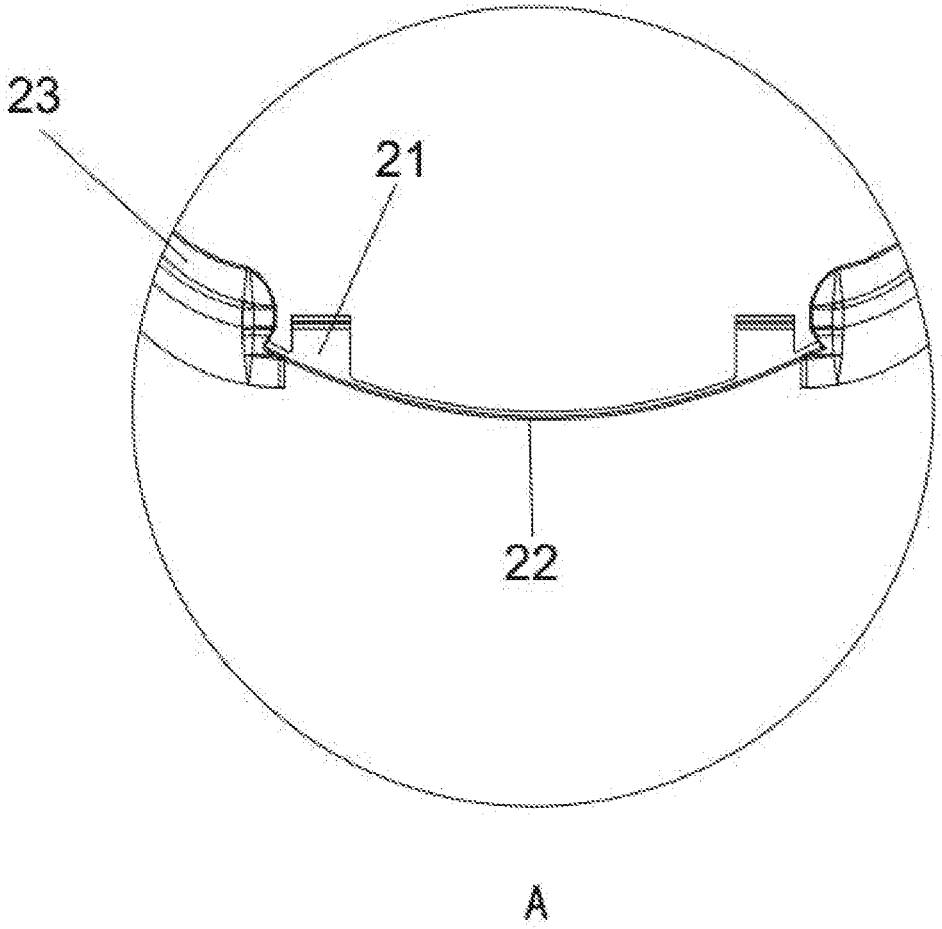
FIG. 4B is a partial enlarged view of the A part in FIG. 4A.
Figure 5:
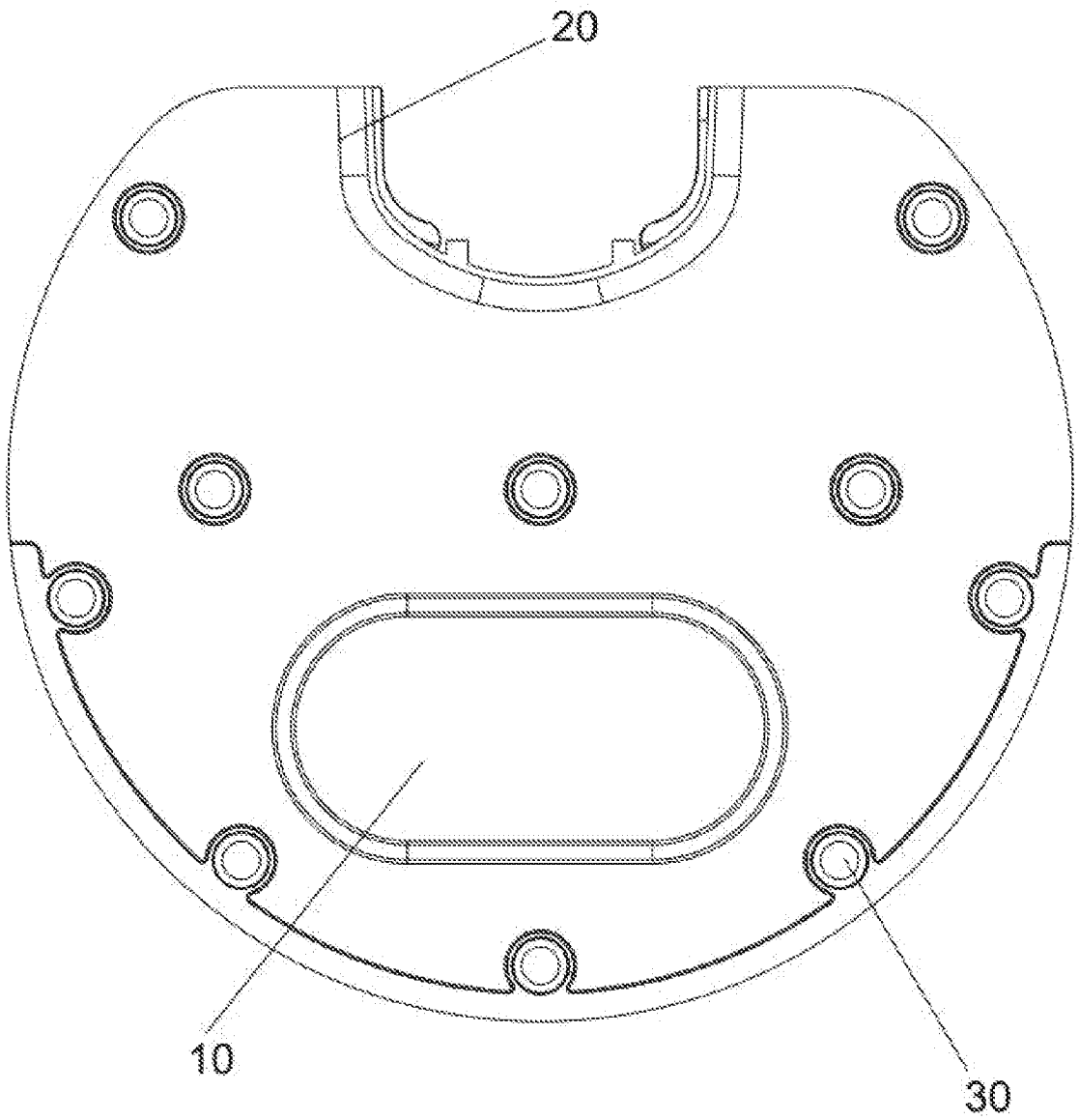
FIG. 5 is a bottom view of the moisture-proof mat of FIG. 4A.
Figure 6:
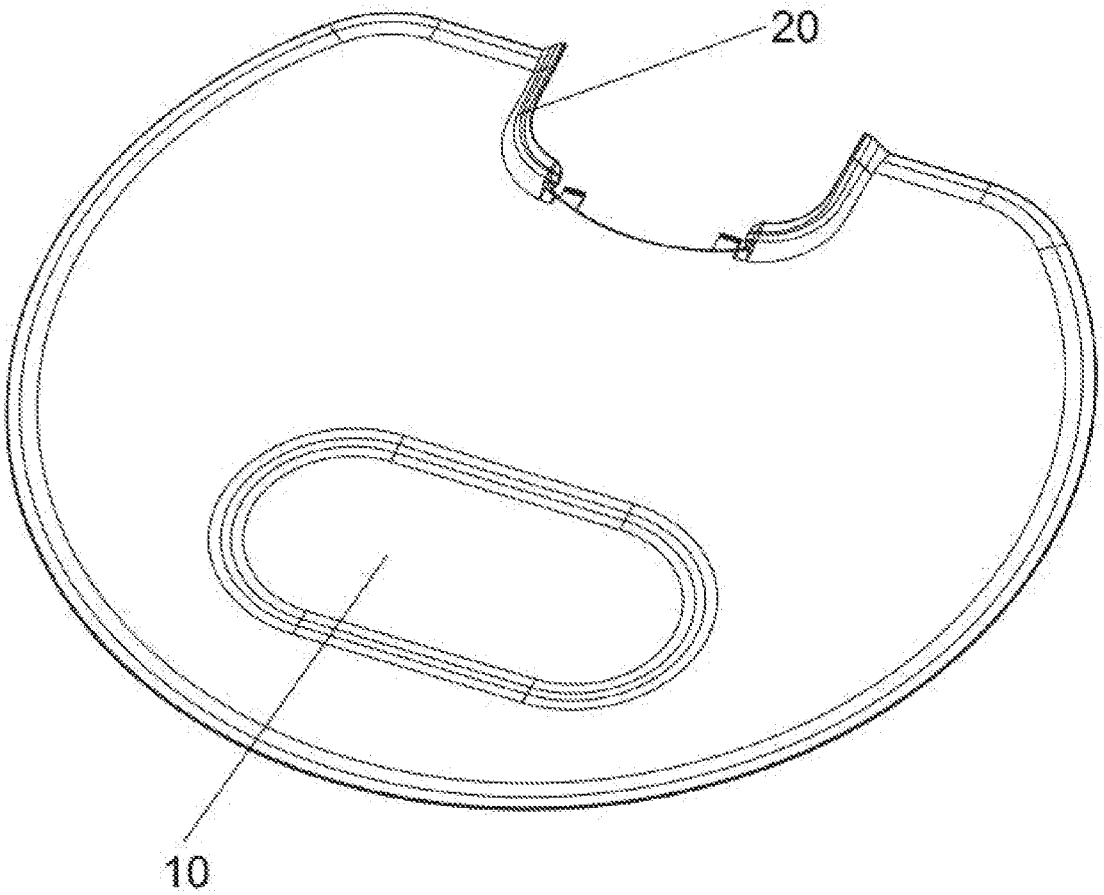
FIG. 6 is a schematic view of the moisture-proof mat of FIG. 4A.

FIG. 1 and FIG. 2 are schematic view of an intelligent cleaning apparatus according to an embodiment. The intelligent cleaning apparatus may include a perception system, a control system (not shown in the FIGS.), a driving system, a power system and a human-machine interaction system 9, in addition to a main body 1 and a cleaning system. The main parts of the intelligent cleaning apparatus are described in detail below.

The main body 1 may include an upper cover, a forward part 13, a backward part 14, and a chassis 11, etc. The main body 1 is roughly round, especially the forward part 13 and the backward part 14 are approximate circular shaped. It can be understood that, the main body 1 can also have other shapes, including but not limited to an approximate D shape.

The perception system may include a position determination device disposed above the main body 1, a bumper disposed on the forward part 13 of the main body 1, a cliff sensor 51, an ultrasonic sensor, an infrared sensor, a magnetometer, an accelerometer, a gyroscope, an odometer, and the like. These sensing devices provide various location information and motion status information of the main body 1 to the control system. The position determination device may include but not limited to an infrared transmitting and receiving device, a camera, and a laser detection sensor (LDS).

The cleaning system may include a dry cleaning unit and a wet cleaning unit. Wherein, the wet cleaning unit is a first cleaning unit 2. A main function of the wet cleaning unit is to wipe the surface to be cleaned (such as the ground) with a cleaning mop 4 containing cleaning liquid. The dry cleaning unit is a second cleaning unit. A main function of the dry cleaning unit is to clean particle contaminants on the surface to be cleaned by an equipment such as a cleaning brush.

As the dry cleaning unit, the main cleaning function of the dry-cleaning unit is derived from the second cleaning unit including a roller brush 61, a dust container, a fan, an air outlet, and the connecting member between the four parts. The roller brush 61 has a certain interference with the ground, sweeps the garbage on the ground and rolls it to the front of the suction port between the roller brush 61 and the dust container. And then the garbage is sucked into the dust container by an air flow generated by the fan and passing through the dust container. The dust removal capability of the sweeper can be characterized by DPU (dust pick up efficiency). The DPU is influenced by the structure and material of the roller brush 61, influenced by the wind power utilization rate of the air duct formed by the suction port, the dust container, the fan, the air outlet, and the connecting member therebetween, and also influenced by the type and power of the fan. Compared to conventional plug-in vacuum cleaners, the improvement of dust removal capability is more meaningful for energy-limited cleaning robots. The improvement of dust removal capability can directly reduce the energy requirements. For example, the robot that can clean 80-square-meter ground with a single charge can be evolved to clean 100-square-meter ground or more. As the number of times of charging is reduced, the battery life will be greatly increased and battery replacement frequency will also decrease. More intuitive and important, the improvement of dust removal capability is the most obvious and important user experience. The user will directly find out whether the cleaning and wiping are clean or not. The dry cleaning system may also include a side brush 62 having a rotating shaft. The rotating shaft is at an angle relative to the ground. The rotating shaft is configured to move the debris into the cleaning area of the roller brush 61, and the rotating shaft is at an angle relative to the ground.

As the wet cleaning unit (such as a wet cleaning pad), the first cleaning unit 2 may mainly include a water tank 3, a cleaning mop 4, and the like. The water tank 3 serves as the base for carrying other components of the first cleaning unit 2. The cleaning mop 4 is detachably disposed on the water tank 3. The liquid in the water tank 3 flows to the cleaning mop 4. The cleaning mop 4 wipes the ground cleaned by the roller brush.

The driving system is configured to drive the main body 1 and components mounted on the main body 1 to move, for automatic travel and cleaning. The driving system may include a drive wheel module. The driving system can issue a drive command to manipulate the robot to travel across the ground. The drive command is based on distance information and angle information, such as x, y and θ components. The drive wheel module can control both the left wheel and the right wheel, in order to control the movement of the machine more precisely. Preferably, the drive wheel module includes a left drive wheel module and a right drive wheel module, respectively. The left drive wheel module and the right drive wheel module are arranged along the horizontal axis alignment defined by the main body 1 (symmetrical setting). In order to make the robot to be able to move more steadily on the ground or to move more efficiently, the robot can include one or more driven wheels 72. The driven wheels include but not limited to a universal wheel.

The drive wheel module may include a travel wheel, a drive motor, and a control circuit configured to control the drive motor. The drive wheel module can also be connected to a circuit for measuring the drive current and an odometer. The drive wheel module can be detachably connected to the main body 1 for easy disassembly and maintenance. The drive wheel may have an offset drop suspension system. The drive wheel is movably fastened, for example, rotatable attached to the main body 1, and receives a spring bias that is biased downward and away from the main body 1. Spring bias allows the drive wheel to maintain contact and traction with the ground with a certain ground force. At the same time, the robot's cleaning element (such as roller brush, etc.) also contact the ground with a certain pressure.

The forward part 13 of the main body 1 can hold the bumper. During the cleaning process, the drive wheel module drives the robot to travel on the ground, and the bumper detects one or more events in the travel path of the robot via a sensor, such as an infrared sensor. The robot can control the drive wheel module by events detected by the bumper, such as obstacles and walls, to enable the robot to respond to events, such as moving away from obstacles.

The control system provided on the circuit board inside the main body 1. The control system may include a non-transitory memory and a computing processor. The non-transitory memory may include a hard disk, a flash memory or a random access memory. The computing processor may include a central processing unit, or an application processor. The application processor uses a positioning algorithm, such as SLAM, to map an instant map in the environment in which the robot is located based on the obstacle information fed back by the laser detection sensor. The distance information and velocity information fed back by the bumper, the cliff sensor 51, and an ultrasonic sensor, an infrared sensor, a magnetometer, an accelerometer, a gyroscope, an odometer and other sensing device are used to determine the current working state of the sweeper. The working state of the sweeping machine may include over the threshold, over the carpet, over the cliff, stuck above or below, dust container full, picked up, etc. The application processor gives specific instructions for the next step for different situations. The robot is more in line with the requirements of the owner, and provides a better user experience. Furthermore, the control system can plan the most efficient cleaning path and cleaning method based on real-time map information drawn by SLAM, which greatly improves the cleaning efficiency of the robot.

The power system may include a rechargeable battery, such as a nickel-metal hydride battery and a lithium battery. The rechargeable battery can be coupled to a charging control circuit, a battery pack charging temperature detecting circuit and a battery under voltage monitoring circuit. The charging control circuit, the battery pack charging temperature detecting circuit and the battery under voltage monitoring circuit connected with the control circuit for the single chip microcomputer. The host is charged by connecting to the charging pile provided on the side or the lower side of the host.

The human-machine interaction system 9 includes buttons on the host panel for the user to select the function. The human-machine interaction system 9 may further include a display and/or an indicator light and/or a speaker, and the display. The indicator light and the speaker show the current state of the machine or the function selection to the user. The human-machine interaction system 9 may also include a mobile client program. For path navigation type cleaning apparatus, the mobile client can show the user the map of the apparatus's environment and the location of the apparatus, which can provide users with more rich and user-friendly functions.

In order to describe robot's behavior more clearly, directions are defined as follows. The robot can travel on the ground by various combinations of movements of the following three mutually perpendicular axes defined by the main body 1: a front and rear axis X (ie, the axis in the direction of the forward part 13 and backward part 14 of main body 1), a lateral axis Y (ie, an axis perpendicular to axis X and at a same horizontal plane with the axis X) and a center vertical axis Z (axis perpendicular to the plane formed by axis X and axis Y). The forward driving direction along the front and rear axis X is indicated as "forward", and the backward driving direction along the front and rear axis X is indicated as "backward". The lateral axis Y extends along the axis defined by the center point of the drive wheel module 71 between the right wheel and the left wheel of the autonomous cleaning robot.

The robot can rotate around the Y axis. When the robot's forward part is tilted upward and the backward part is tilted downward, it is defined as "up", and when the forward part of the robot is tilted downward and the backward part is tilted upward, it is defined as "down". In addition, the robot can rotate around the Z axis. In the forward direction of robot, when the robot tilts to the right of the X axis, it is defined as "right turn", when the robot tilts to the left side of the X axis, it is defined as "left turn".

The dust container is mounted in the accommodating cavity by means of buckle and handle. When the handle is pulled, the buckle shrinks. When the handle is released, the buckle extends to a recess of the accommodating cavity that receives the limiting member.

Preferably, the pressure in the water tank 3 is equal to or slightly lower than atmospheric pressure. Therefore, the liquid discharge hole does not discharge the liquid without an external force. A liquid discharge structure (water outlet filter) is installed at the liquid outlet hole, the liquid outlet hole is usually equipped with a cleaning mop 4 having water absorption. The intelligent cleaning apparatus is configured to discharge the liquid through the liquid outlet hole under the action of suction, when the liquid discharge structure is in conflict with the cleaning mop 4. Preferably, when the intelligent cleaning apparatus is on a flat surface without recess or protrusions, the cleaning mop 4 is slightly interfered with the surface, to make the cleaning mop 4 against the surface, apply a continuous force to the liquid discharge structure, so that the liquid outlet hole can discharge the liquid evenly.

The charging station is used to charge the intelligent cleaning apparatus. The charging station is usually placed somewhere on a plane surface, for example, the floor near a wall or a corner, and the intelligent cleaning apparatus can be moved to the position of the charging station. When the intelligent cleaning apparatus is at the position, the charging station can charge the intelligent cleaning apparatus.

When the intelligent cleaning apparatus is charged by the charging station, the intelligent cleaning apparatus usually stays still for a long time. But the liquid in the water tank 3 may be continuously discharged or leaked through the liquid outlet hole, which may damage the floor. Therefore, moisture-proof mat 100 is also provided at the charging station, when the intelligent cleaning apparatus is charged. The moisture-proof mat 100 is located below the intelligent cleaning apparatus (ie, the charging location of the intelligent cleaning apparatus is above the moisture-proof mat 100). Preferably, the moisture-proof mat 100 is made of a hard material such as a hard glue, and has good waterproof performance.

Preferably, the general outline of the moisture-proof mat 100 matches the shape of the intelligent cleaning apparatus. The moisture-proof mat 100 can be connected to the charging station. The moisture-proof mat 100 may include an installation unit configured to install the moisture-proof mat to the charging station. Specifically, the installation unit is a notch defined on the edge of the moisture-proof mat. The notch is recessed from the edge toward the center of the moisture-proof mat, so as to partially surround the charging station. The shape of the notch 20 matches the shape of the outer peripheral surface of the charging station, thereby making the notch 20 fit within the charging station. In a specific embodiment, and the outer contour of the charging station is inserted into the notch 20.

It should be understood, the extending direction or the set direction (eg, "horizontal", "vertical") of the various components is refer to the extending direction or the set direction thereof when the intelligent cleaning system is disposed on a horizontal plane.

Preferably, the notch 20 is provided with a buckle 23 for matching the outer peripheral surface of the charging station. The buckle 23 extends along the edge of the notch 20 horizontally. The buckle 23 may include a first portion extending perpendicular to the extension direction of the moisture-proof mat and a second portion extends from the upper end of the first portion toward the charging station. When the moisture-proof mat 100 is installed to the charging station, the buckle 23 is able to fasten the edges of the charging station, for example, the edge of the joint on the charging station. Specifically, when the buckle 23 fastened to the edge of the charging station, the first portion is in contact with the side wall of the charging station, and the bottom surface of the second portion is in contact with the top wall of the charging station.

Also preferably, the notch 20 is also provided with a protrusion 21 extending horizontally toward the charging station, and the charging station is provided with a groove corresponding to the protrusion 21. When the moisture-proof mat 100 is fastened to the charging station, the protrusion 21 can be inserted into the groove, thereby the moisture-proof mat 100 being fixed with the charging station. More preferably, there are two protrusions 21, two protrusions 21 symmetrically set about the axis of the notch 20. Of course, it can be understood, in other embodiments not shown, the protrusion may be provided on the charging station, and the groove may be defined on the moisture-proof mat.

The inner part of notch 20 is a curved part 22, the curved part 22 is positioned between two protrusions 21. It can be understood that, when the curved part 22 is in full contact with the charging station, the moisture-proof mat 100 is installed in place.

Preferably, the moisture-proof mat 100 may include a recess portion 10. When the intelligent cleaning apparatus is in the charging position, the recess portion 10 is located below the water tank 3. Seen from the top view and the bottom view of the moisture-proof mat 100, the middle part of the recess portion 10 is roughly rectangular, and the ends of the recess portion 10 are semi-circular, the shape of the recess portion 10 corresponds to the shape of the water tank 3.

In the present embodiment, the liquid discharge structure at the liquid outlet hole of the water tank 3 is configured to protrude downward from the bottom surface of the water tank 3 by 0.2 to 0.5 mm. The distance between the bottom surface of the recess portion 10 and the top surface of the moisture-proof mat 100 is 0.6-0.8 mm. In this way, when the intelligent cleaning apparatus is charged, there is a gap between the bottom surface of the recess portion 10 and cleaning mop 4, therefore, no upward force is applied to the liquid discharge structure, the liquid outlet hole on the water tank 3 does not contact with the cleaning mop 4, and liquid will not be drawn from the liquid outlet hole.

Preferably, the moisture-proof mat 100 may further include more than one antiskid device 30 disposed on the bottom of the moisture-proof mat and protruding therefrom. The antiskid device 30 has a circular cross section. The antiskid device 30 is made of a flexible material. The lower end of the antiskid device 30 has a larger diameter than the middle or upper part has, thereby forming a suction cup structure, to secure the moisture-proof mat 100 on a flat surface. More preferably, the antiskid device 30 can be made of transparent and/or waterproof materials, to make the antiskid device 30 have a better appearance. Referring to FIG. 2, the antiskid devices 30 can be evenly distributed at the bottom of the moisture-proof mat 100. A plurality of the antiskid devices 30 are disposed at an edge of the moisture-proof mat 100 away from the end being connected to the charging station, thereby further optimizing the fixing effect of the antiskid device 30.

Figure 7:
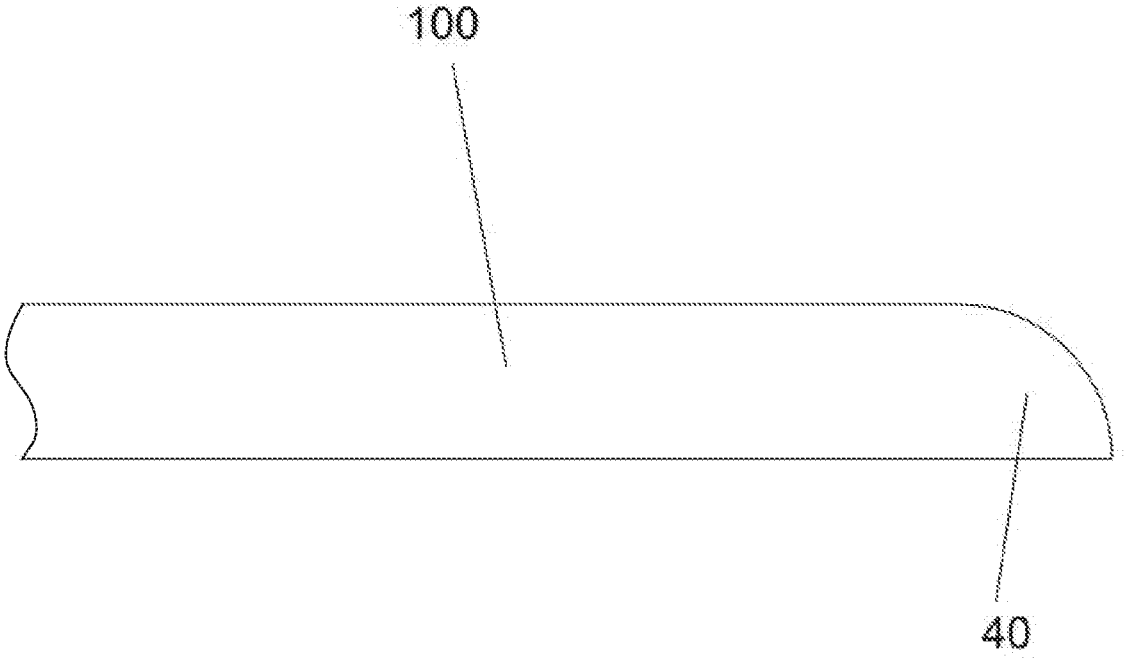
FIG. 7 is a schematic view of the rounded edge of the moisture-proof mat of FIG. 4A.

Preferably, referring to FIG. 7, the moisture-proof mat 100 has an rounded edge 40, and the side walls and the surface of the moisture-proof mat 100 are connected by the rounded edge 40. Due to the rounded edge 40, the intelligent cleaning apparatus can move onto the moisture-proof mat 100 more conveniently.

According to the present disclosure, when the intelligent cleaning apparatus is charged by the charging station, the moisture-proof mat is under the intelligent cleaning apparatus, so that the surface for placing the intelligent cleaning apparatus is less susceptible to moisture and damage. The moisture-proof mat 100 is detachably connected to the charging station to facilitate installation, disassembly, storage and transportation of the intelligent cleaning system.

Unless otherwise defined, the technical and scientific terms used herein have the same meaning as commonly understood by one of ordinary skill in the art. The terminology used herein is for the purpose of describing particular embodiments, not intended to limit the disclosure. Terms such as "parts" appearing in this document can refer to individual parts, it can also refer to a combination of multiple parts. Terms such as "installation", "setting" and the like appearing herein may mean that one component is directly attached to another component, it is also possible to indicate that one component is attached to another component through the intermediate piece. Features described herein in one embodiment may be applied to another embodiment, either alone or in combination with other features, unless this feature is not applicable or otherwise stated in this alternative embodiment.

The disclosure has been described by the above embodiments, but it should be understood that, the above embodiments are for the purpose of illustration and description only, it is not intended to limit the invention to the scope of the described embodiments.

What is claimed is:

1. A moisture-proof mat for an intelligent cleaning apparatus, the intelligent cleaning apparatus being provided with a wet cleaning pad and configured to be chargeable by a charging station, wherein the moisture-proof mat is detachably connected to the charging station and comprises:

an installation unit formed in shape of a notch or a protrusion, configured to install the moisture-proof mat to the charging station, wherein at least a part of the moisture-proof mat is configured to be located under the wet cleaning pad, when the intelligent cleaning apparatus is charged by the charging station.

2. The moisture-proof mat as claimed in claim 1, further comprising at least one antiskid device disposed on a bottom surface of the moisture-proof mat, wherein the at least one antiskid device includes flexible material and is configured to protrude downwardly from the bottom surface of the moisture-proof mat.

3. The moisture-proof mat as claimed in claim 1, further including a recess portion, wherein the recess portion is configured to be located below a liquid discharge portion provided on a bottom surface of the wet cleaning pad, and an upper surface of the recess portion does not contact the liquid discharge portion when the intelligent cleaning apparatus is charged by the charging station.

4. The moisture-proof mat as claimed in claim 1, wherein a shape of the moisture-proof mat corresponds to a cross-sectional shape of the intelligent cleaning apparatus.

5. The moisture-proof mat as claimed in claim 1, wherein the installation unit comprises the notch defined on an edge of the moisture-proof mat, the notch is recessed from the edge toward a center of the moisture-proof mat and configured to at least partially surround the charging station.

6. The moisture-proof mat as claimed in claim 5, wherein the notch comprises at least one of:

a buckle, configured to be attachable with an outer peripheral surface of the charging station, the buckle comprising a first portion extending upwardly from a bottom surface of the moisture-proof mat and a second portion extending from an upper end of the first portion toward the charging station, another protrusion, configured to extend toward the charging station and be insertable into a groove portion of the charging station, or a groove, configured to accommodate a protrusion portion of the charging station.

7. The moisture-proof mat as claimed in claim 1, wherein an upper surface of the moisture-proof mat is provided with a rounded edge to allow ease movement of the intelligent cleaning apparatus over the moisture-proof mat.

8. An intelligent cleaning system, comprising:

a charging station;

an intelligent cleaning apparatus, provided with a wet cleaning pad and configured to be chargeable by the charging station; and a moisture-proof mat, being detachably connected to the charging station and comprising an installation unit, wherein the installation unit is formed in shape of a notch or a protrusion and is configured to install the moisture-proof mat to the charging station, and at least a portion of the moisture-proof mat is configured to be located under the wet cleaning pad when the intelligent cleaning apparatus is charged by the charging station.

9. The intelligent cleaning system as claimed in claim 8, wherein a portion of the installation unit comprises the protrusion positioned to cooperate with a groove of the charging station to install the moisture-proof mat to the charging station.

10. The intelligent cleaning system as claimed in claim 8, the moisture-proof mat further comprising a liquid discharge portion disposed on the bottom surface of the wet cleaning pad, and the liquid discharge portion is configured to output the liquid in the wet cleaning pad when subjected to a pressure.

11. The moisture-proof mat as claimed in claim 1, wherein a shape of the moisture-proof mat is substantially round with a notch.

12. The intelligent cleaning system as claimed in claim 8, further comprising at least one antiskid device disposed on a bottom surface of the moisture-proof mat, wherein the at least one antiskid device includes flexible material and is configured to protrude downwardly from the bottom surface of the moisture-proof mat.

13. The intelligent cleaning system as claimed in claim 8, further includes a recess portion, wherein the recess portion is configured, when the intelligent cleaning apparatus is charged by the charging station, to be located below a liquid discharge portion provided on a bottom surface of the wet cleaning pad and an upper surface of the recess portion does not contact the liquid discharge portion.

14. The intelligent cleaning system as claimed in claim 8, wherein a shape of the moisture-proof mat corresponds to a shape of a bottom of the intelligent cleaning apparatus.

15. The intelligent cleaning system as claimed in claim 8, wherein a shape of the moisture-proof mat is proximately round with a notch.

16. The intelligent cleaning system as claimed in claim 8, wherein the installation unit comprises the notch defined on an edge of the moisture-proof mat, the notch is recessed from the edge toward a center of the moisture-proof mat and configured to partially surround the charging station.

17. The intelligent cleaning system as claimed in claim 16, wherein the notch comprises at least one of:

a buckle, configured to be attachable with an outer peripheral surface of the charging station, the buckle comprising a first portion extending upwardly from a bottom surface of the moisture-proof mat and a second portion extending from an upper end of the first portion toward the charging station, another protrusion, configured to extend toward the charging station and be insertable into a groove portion of the charging station, or a groove, configured to accommodate a protrusion portion of the charging station.

18. The intelligent cleaning system as claimed in claim 8, wherein an upper surface of the moisture-proof mat is provided with a rounded edge to allow ease movement of the intelligent cleaning apparatus over the moisture-proof mat.

19. The intelligent cleaning system as claimed in claim 8, wherein a portion of the installation unit defines a groove positioned to cooperate with a protrusion of the charging station to install the moisture-proof mat to the charging station.

* * * * *